US005455657A

United States Patent [19]

Takeda

[11] Patent Number: 5,455,657

[45] Date of Patent: Oct. 3, 1995

[54] IMAGE FORMING APPARATUS WITH IMAGE DENSITY ADJUSTMENT

[75] Inventor: Atsushi Takeda, Kawasaki, Japan

[73] Assignee: Canon Kabushiki Kaisha, Tokyo, Japan

[21] Appl. No.: 972,213

[22] Filed: Nov. 5, 1992

[30] Foreign Application Priority Data

Nov. 8, 1991 [JP] Japan ..... 3-320892

[51] Int. Cl.[6] ..... G03G 21/00; G03G 15/02

[52] U.S. Cl. ..... 355/208; 355/207; 355/214; 355/219; 355/246

[58] Field of Search ..... 355/246, 219, 355/214, 204, 203, 282, 285, 228, 205, 229, 207, 232, 208; 219/216

[56] References Cited

U.S. PATENT DOCUMENTS

| | | | |
|---|---|---|---|
| 4,603,245 | 7/1986 | Yagasaki | 219/216 |
| 5,083,167 | 1/1992 | Fukushima et al. . | |
| 5,128,717 | 7/1992 | Uchikawa et al. . | |

FOREIGN PATENT DOCUMENTS

| | | | |
|---|---|---|---|
| 58-24155 | 2/1983 | Japan . | |
| 63-264771 | 11/1988 | Japan | 355/204 |
| 2205078 | 8/1990 | Japan . | |
| 3033771 | 2/1991 | Japan . | |
| 3-033771 | 2/1991 | Japan . | |

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

An image forming apparatus includes an electrophotographic photosensitive member; a charger for charging the photosensitive member; an exposure device for exposing the photosensitive member to light information with a controllable amount of light to form an electrostatic latent image with a controlled image density; a developing device for developing the electrostatic latent image with toner; an image fixing device for heat-fixing the toner image; a detector for detecting, in effect, electric power consumed by the image forming apparatus in operation; a power supply controller for controlling electric power supply to the apparatus without changing electric power supply to the fixing device and without increasing electric power supply to the exposure device; an image density adjusting device for adjusting image density without changing the light amount of the exposure device; wherein when the detector detects the power consumption beyond a predetermined level, the electric power supply to the exposure device is reduced or is maintained constant and the image density adjusting device is operated, without changing the electric power supply to the fixing device, so as to adjust the density of the image.

23 Claims, 5 Drawing Sheets

IMAGE FORMING APPARATUS WITH IMAGE DENSITY ADJUSTMENT

FIELD OF THE INVENTION AND RELATED ART

The present invention relates to an image forming apparatus such as a copying machine in which an electrostatic latent image is formed by exposure means provided with an exposure amount adjusting function, and, thereafter, a visualized (toner) image is fixed on a transfer material by an image fixing device provided with a heating source.

A conventional copying machine as an image forming apparatus is provided with exposure lamp as a part of exposure means and a heater as a part of a fixing device. In such a copying machine, electric power consumption of the exposure lamp and the heater occupies a significant part of the electric power consumed by the entire of the apparatus. Particularly in a high speed copying machine, an image fixing roller has to be supplied with large amount of sheet through the heater, and therefore, the power consumption tends to increase.

As regards the power consumption of the exposure lamp, when the image density is decreased, the exposure amount by the exposure lamp is usually increased, and therefore, power consumption also increases.

As for another method of decreasing the image density, Japanese Laid-Open Patent Application No. 03-33771 discloses that an output of the exposure lamp is preset in a predetermined range, and a developing bias for a developing device or a charging amount of a charging device is controlled outside the predetermined range.

Japanese Patent Application Publication No. 25058 discloses that when the image density is to be increased beyond a standard level, the exposure amount is changed while maintaining the standard level of the developing bias; and wherein the image density is to be lower than the standard level, the developing bias is changed while maintaining the standard level of the exposure amount. Japanese Patent Application No. 123316 discloses that when the image density is to be increased over a standard level, the exposure amount is changed while maintaining a constant charging amount; and when the image density is to be decreased, the charge amount is changed while maintaining a constant exposure amount.

In any of the above cases, the electric power to be supplied to the fixing device is set for its usual operation. Therefore, when a large number of copies are to be produced continuously, or the like, it takes long time for the temperature of the fixing device to reach the level sufficient to fix the toner image. In such a case, the copying speed has to be lowered, or the copying operation has to be stopped until temperature of the fixing device reaches the predetermined level. Thus, as regards the exposure device and the fixing device as the elements consuming the electric power, the priority has been placed on the electric power to be supplied to the exposure device in the prior art. For this reason, even if more electric power is required by the fixing device as in the high speed copying operation than usual operation, the electric power supply has not been sufficient as the case may be.

If the developing bias or the charge amount is changed in order to decrease the image density, it results that the maximum image density is relatively low.

SUMMARY OF THE INVENTION

Accordingly, it is a principal object of the present invention to provide an image forming apparatus in which even under the image fixing condition as in the high speed copying operation or the like, the image deterioration can be prevented without reduction of the copy speed.

According to an aspect of the present invention, there is provided an image forming apparatus, comprising: an electrophotographic photosensitive member; means for charging said photosensitive member; exposure means for exposing said photosensitive member to light information with a controllable amount of light to form an electrostatic latent image with a controlled image density; developing means for developing the electrostatic latent image with toner; image fixing means for heat-fixing the toner image; detecting means for detecting, in effect, electric power consumed by said image forming apparatus in operation; power supply control means for controlling electric power supply to said apparatus without changing electric power supply to said fixing means and without increasing electric power supply to said exposure means; image density adjusting means for adjusting image density without changing the light amount of said exposure means; wherein when said detecting means detects the power consumption beyond a predetermined level, the electric power supply to said exposure means is reduced or is maintained constant and said image density adjusting means is operated, without changing the electric power supply to said fixing means, so as to adjust the density of the image.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, an embodiment of the present invention will be described.

Figure 1:
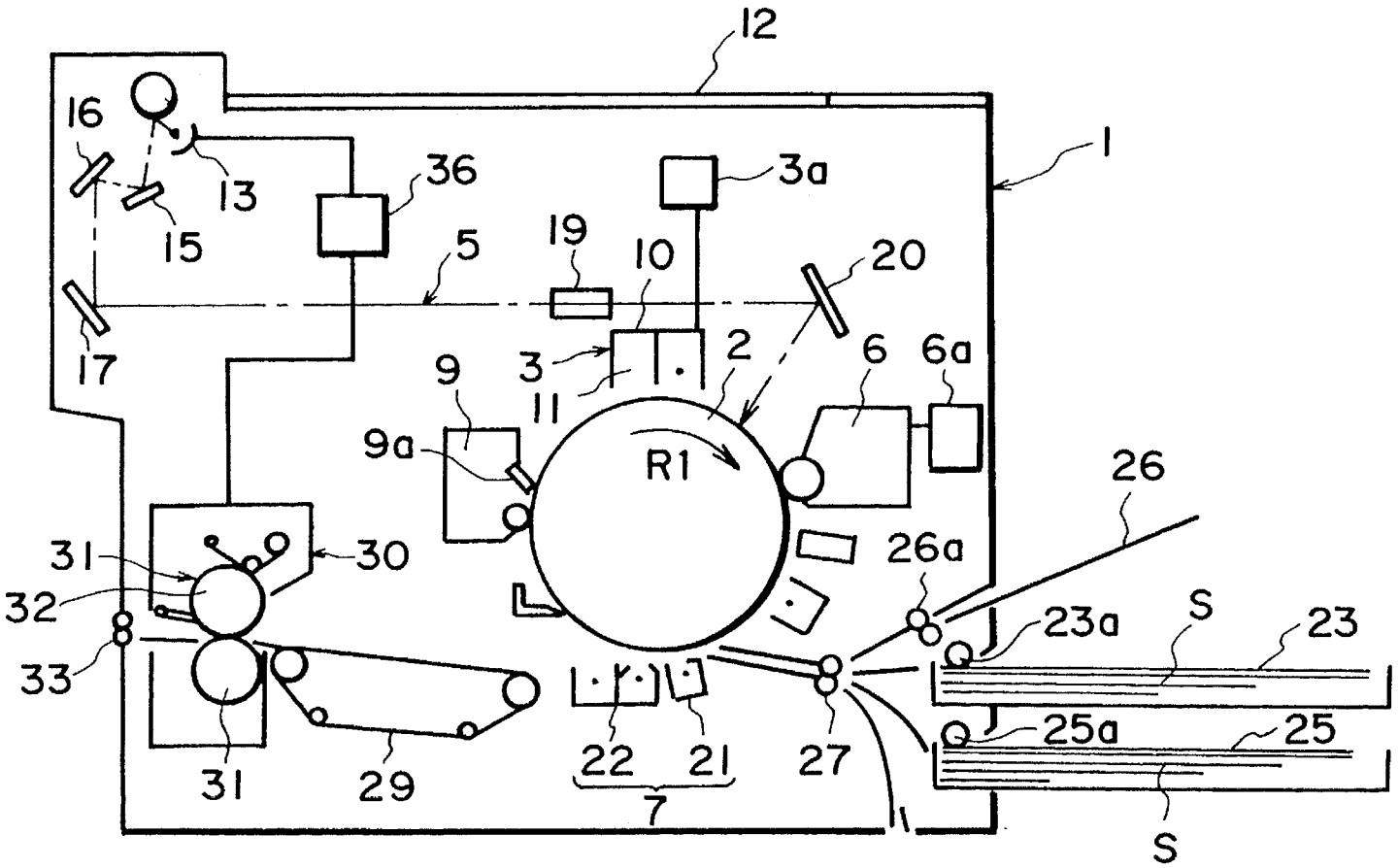
FIG. 1 is a sectional view of a copying apparatus according to an embodiment of the present invention.

Referring to FIG. 1, there is shown an exemplary image forming apparatus to which the present invention is applicable.

The main assembly 1 of the copying machine comprises an image bearing member in the form of a photosensitive member 2 which is rotatable. Around the photosensitive member 2, there are provided a primary charger (charging device) 3, exposure means 5, image transfer means 7 and a cleaning device 9 or the like in the order named along the rotational direction R1.

The charging device 3 includes a shielding member 10 and a discharge wire 11 in the opening of the shielding member 10. By applying a high voltage to the discharging wire 11, the surface of the photosensitive member 2 is uniformly charged to a predetermined potential of positive (+) polarity, for example.

The exposure means 5 includes a halogen lamp (exposure lamp) 13 functioning as exposure amount control means for illuminating an original placed on an original supporting platen glass 12 at the top part of the main assembly 1. The light emitted from the halogen lamp 13 is reflected by the image surface of an original, and the reflected light is projected on the surface of the photosensitive member 2 by way of scanning mirrors 15, 16 and 17, a lens 19 and a scanning mirror 20. By doing so, an electrostatic latent image is formed on the surface of the photosensitive member 2. The electrostatic latent image comprises a low potential portion at a light area corresponding to the white portion of the original and a high potential portion at a dark area corresponding to a black portion (image portion) of the original.

The developing device 6 functions to deposit a developer (toner) on an electrostatic latent image to form a toner image. To the developing device 6, a DC bias voltage having a voltage level between the dark portion potential and the light portion potential is applied, so that the formed toner image has image densities corresponding to the development contrast which in turn corresponds to a difference between the dark portion potential and the DC bias voltage.

The toner image formed on the photosensitive member 2 is transferred onto a transfer material S from the photosensitive member 2 by the transfer means 7 having a transfer charger 21 and a separation charger 22. The transfer material S has been supplied from one of a top cassette 23, a bottom cassette 25 and a manual sheet feed port 26 at the front side (right side) of the main assembly 1, by a sheet feeding roller 23*a*, 25*a* or 26*a*. It is supplied to the photosensitive member 2 in synchronism therewith by a registration roller couple 27.

The transfer material S now having the toner image transferred thereto by the transfer device 7, is conveyed to the downstream fixing device 30 on a conveyer belt 29.

The fixing device 30 comprises a fixing heater 32 in a fixing roller 31. The toner image is fixed on the transfer material by combination of heating of said fixing heater and pressure by the fixing roller 31.

Subsequently, the transfer material S is discharged to an outside of the main assembly 1 by a discharge roller 33.

Residual toner remaining on the photosensitive member 2 not transferred by the transfer device 7, is removed from the photosensitive member 2 by a cleaning blade 9*a* of the cleaning device 9.

The photosensitive member 2 is then charged again by the primary charger 3 for preparation for the next image forming operation.

FIRST EMBODIMENT

Figure 2:
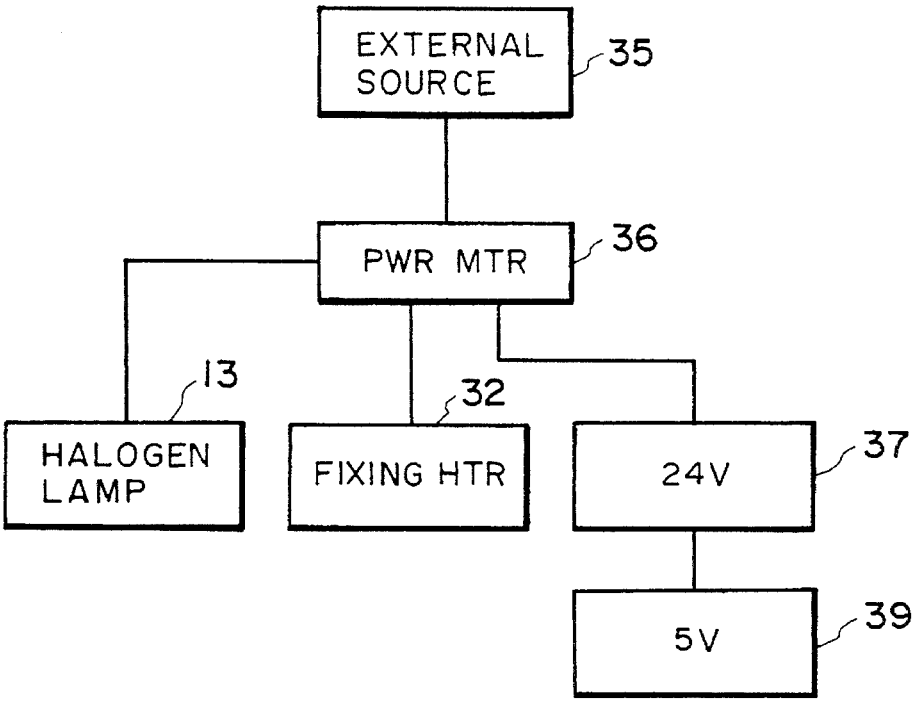
FIG. 2 is a block diagram of an electric power source.

Referring to FIGS. 2–6, the description will be made as to the first embodiment. FIG. 2 is a block diagram of electric power source in which a main switch of the main assembly 1 is in on-state. A power meter 36 (power consumption detecting means) is connected to an external power source 35 through a plug, and is connected with the halogen lamp (rated power: 70 V - 220 W) 13, the fixing heater 32 and 24 V voltage source 37. The 24 V voltage source 37 is further connected with a 5 V power source 39. Most of the power consumption detected by the power meter 36 is that consumed by the halogen lamp and the fixing heater 32. The power meter 36, it detects more than 1500 W (1500 Wmax), for example, controls power supply to reduce the power consumption to not more than 1500 V, in the manner which will be described hereinafter.

Figure 3:
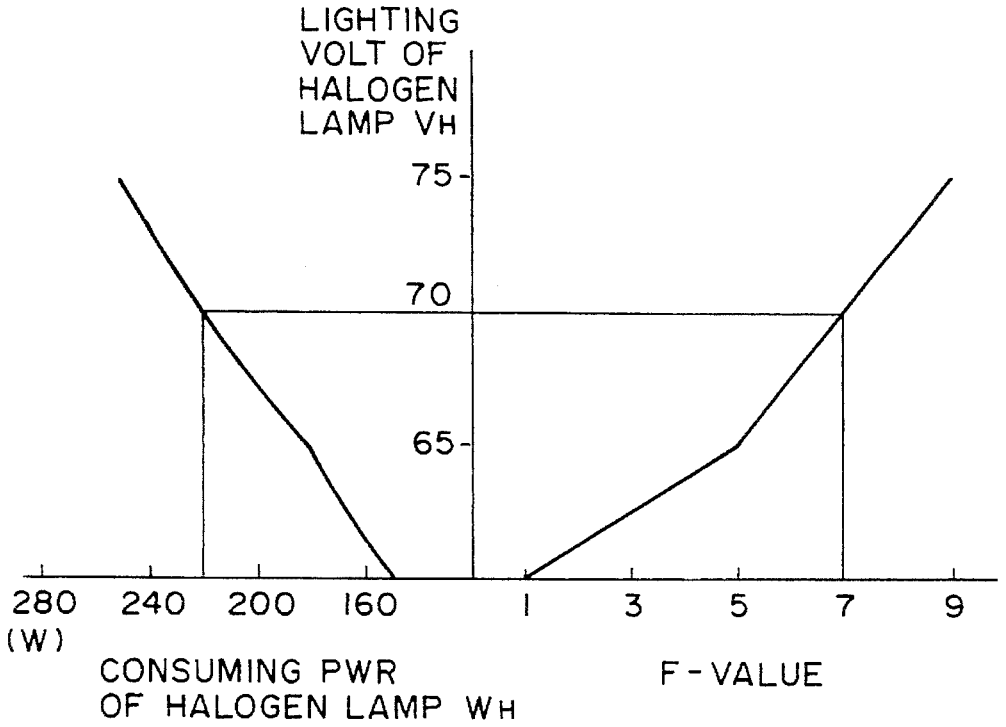
FIG. 3 is a graph showing a relationship among an on-set voltage of the halogen lamp, power consumption and an f-value.

FIG. 3 shows a relationship between a voltage supplied to the halogen lamp $V_H$ and halogen lamp power consumption $W_H$, for image density level (F-value). The F-value is usually 1–9, and it is set as desired by moving a lever or the like on an operation panel of the main assembly 1. With this increase of the F-value in the positive development, the halogen lamp voltage $V_H$ and the halogen lamp power consumption $W_H$ both increase, and the final image density decreases. If, on the other hand, the F-value is decreased, the image density increases in the case of positive development.

Figure 4:
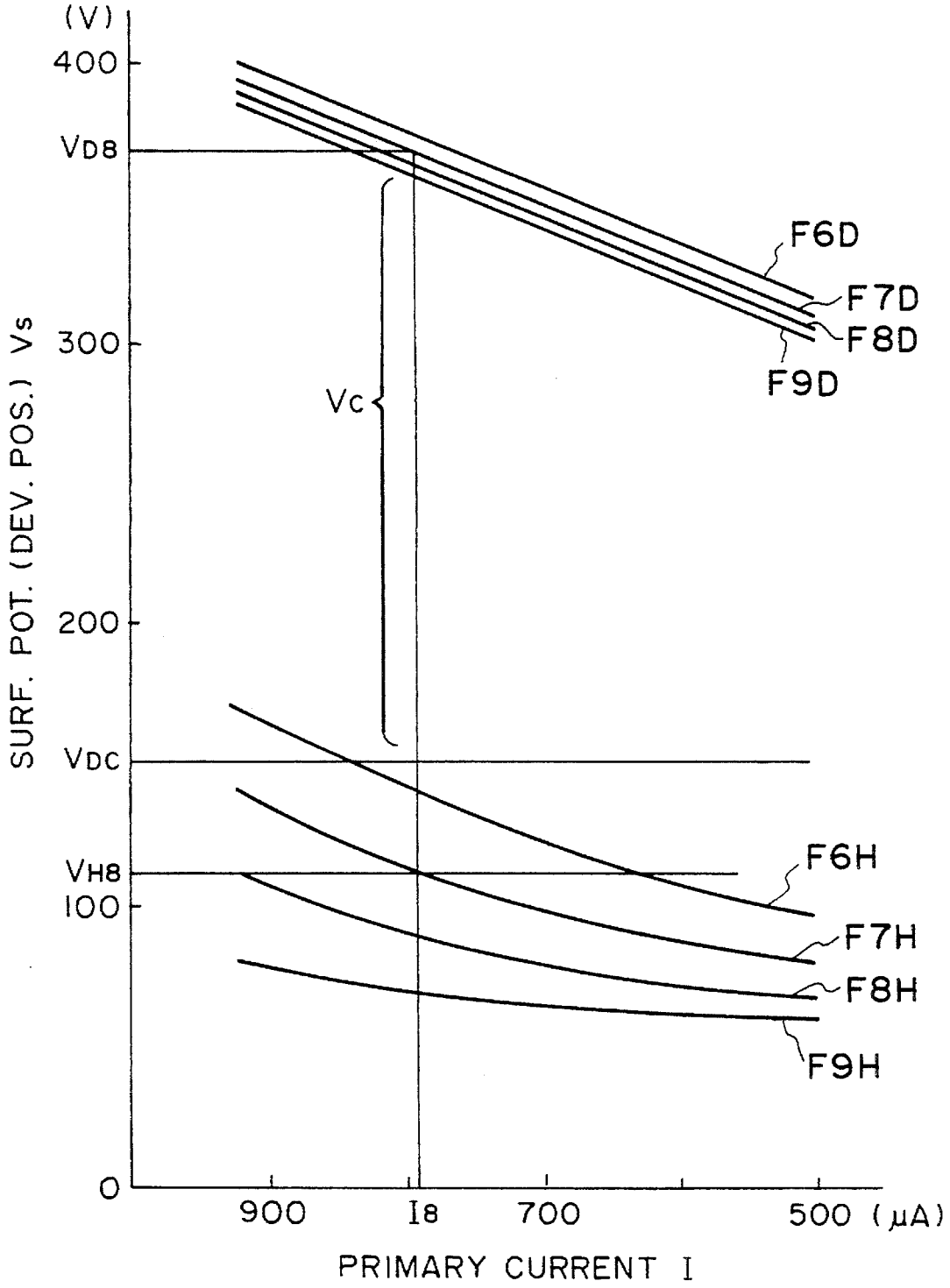
FIG. 4 is a graph showing a relationship between a primary current and a surface potential of a photosensitive member.

FIG. 4 shows a relationship between a primary current I flowing between the charging device 3 and the photosensitive member 2 and a surface potential $V_S$ of the photosensitive member at the developing position, when the charging device 3 is supplied with a high voltage. In this Figure, lines F6D, F7D, F8D and F9D are dark potential $V_D$ (white portion of original image) on the surface of the photosensitive member 2 when the F-value takes 6, 7, 8 and 9, respectively. Lines F6H, F7H, F8H and F9H are the light potential (black portion of the original image) $V_H$. Both of the dark potential $V_D$ and light potential $V_H$ decrease with decrease of the primary current I. In the Figure FDC is development bias voltage applied to the developing device 6, and the difference between the dark potential $V_D$ and the developing bias voltage $V_{DC}$ is a development contrast $V_C$. The developing bias voltage $V_{DC}$ may be changed by bias adjusting means 6*a* (FIG. 1) connected to the developing device 6.

Figure 5:
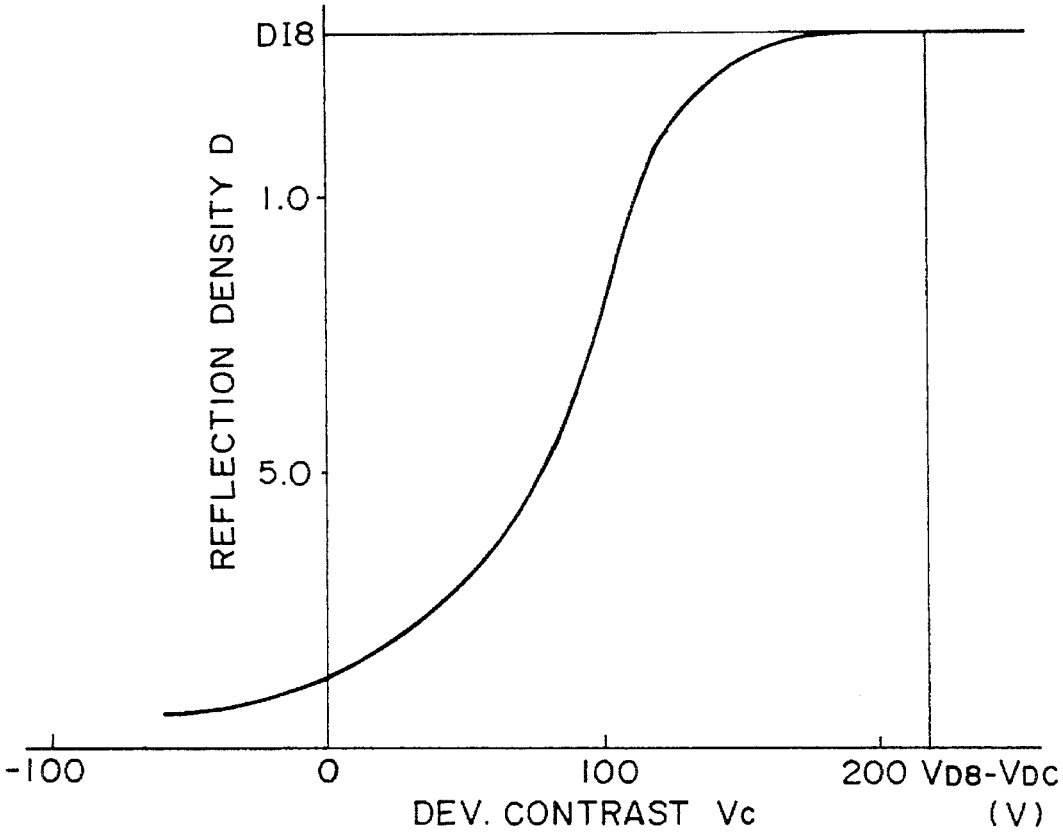
FIG. 5 is a graph showing a relationship between a development contrast and a reflection density.

FIG. 5 shows a (reflection) image density of the toner image transferred onto the transfer material S, relative to the development contrast $V_C$.

Figure 6:
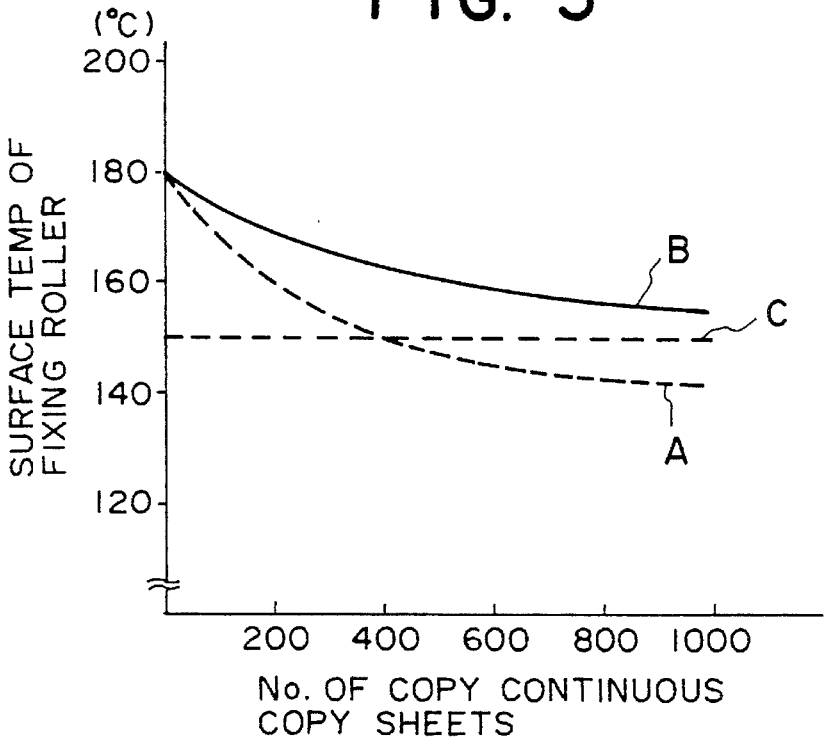
FIG. 6 is a graph showing a relationship between a number of continuous copying operations and a surface temperature of a fixing roller.

FIG. 6 shows a relationship between a number of continuous copies and a surface temperature of the fixing roller 31 of the fixing device 30 when a continuous copying operation is carried out in the copying machine. In this Figure, broken line C represents a temperature (150° C. for example) for assuredly fixing the toner image on the transfer material S. Curves A (broken line) and B (solid line) represent the changes of the fixing roller surface temperature when the fixing device 30 is supplied with 850 W and 880 W, respectively. When the power supply (power consumption) is 880 W, there is no problem. However, when the power supply is 850 W, the surface temperature of the fixing roller lowers beyond a predetermined level (150° C. in this example) when the integrated number of continuous copy operations exceeds 400. With this state, the toner image is not sufficiently fixed on the transfer material S. Therefore, conventionally, the copying speed is decreased, or the copying operation is temporarily stopped to wait for the fixing roller surface temperature to restore the predetermined level.

Examples of the present invention will be described.

First, the maximum level of the power meter 36 is set to 1500 W, and the power of the fixing device 6 is set to 880 W. By doing so, as shown in FIG. 6, the surface temperature of the fixing roller is maintained above 150° C. even if the copying operation is carried out continuously. Therefore, the toner images can be assuredly fixed on the transfer materials S without occurrence of improper image formation.

It is assumed that when the power meter detects 1500 W, the power consumption of the halogen lamp 13 is 225 W. As will be understood from FIG. 3, the voltage $V_H$ supplied to the halogen lamp 13 is less than 71 V. When the voltage supplied to the exposure lamp is 70 V, the F-value is F7. If the F-value is larger than F-7, that is, if the power consumption of the halogen lamp 13 is higher than 220 V, the primary current I is changed in the following manner.

In order to change the primary current I of the primary charger 3 (charger control) so as to provide equivalent change of the light quantity of the halogen lamp (light quantity control) of the exposure means, corresponding to 0.3 original image density, it will be understood from FIG. 4 that if F-value is F8, for example, the primary charger 3 is supplied with the current I8 (792 μA) with which the line F7H is equal to the F8 voltage $V_{H8}$ in FIG. 4. In this case, the surface potential $V_S$ of the photosensitive member corresponding to the maximum Dmax of the final image is $V_{D8}$, and the development contrast $V_C$ is $V_{D8}-D_{DC}$ (=218 V). From FIG. 5, the density D of $V_{D8}V_{DC}$ is $D_{I8}$ (1.30). Table 1 shows the primary current I for F7, F8 and F9, the percentage relative to the primary current for F7, the development contrast $V_D$ and the Dmax density.

TABLE 1

| F-value | Primary current (μA) | Primary current rate (%) | Dev. contrast $V_C$ (V) | Dmax. density |
|---|---|---|---|---|
| 7 | 920 | 100 | 244 | 1.30 |
| 8 | 792 | 86 | 218 | 1.30 |
| 9 | 556 | 61 | 168 | 1.28 |

Thus, when the power consumption exceeds the predetermined level (1500 W), the primary current is changed by a predetermined rate (as shown in Table 2) on the basis of the exposure amount and the primary current I for the F-value resulting in the power consumption in the predetermined range.

TABLE 2

| F-value change | Primary current output rate (%) |
|---|---|
| 0 | 100 |
| 1 | 86 |
| 2 | 61 |
| 3 | 36 |

FIG. 6 shows the change of the surface temperature of the fixing roller 31 relative to the number of copies continuously produced, as described hereinbefore. Broken line A shows the surface temperature change in the conventional apparatus (the wattage of the fixing heater 32 is 850 W, for example). Broken line C is the surface temperature of the fixing roller at which the fixing property is deteriorated. It will be understood that the fixing performance is deteriorated after 400 sheets are continuously processed. Broken line B represents the case in which the wattage of the fixing heater is 880 W. It will be understood that the fixing performance is not deteriorated even after 1000 sheets are continuously processed. The difference of 30 W from the conventional fixing heater wattage, as the wattage required for changing the halogen lamp shown in FIG. 3 from F7 to F9. This is compensated by the charger control.

In this embodiment, the power meter 36 detects the power consumption $V_W$ of the halogen lamp, but it is a possible alternative that a voltage detecting means (not shown) detects a voltage (supplied voltage $V_H$) applied to the halogen lamp 13 since there is one-to-one relationship between the voltage $V_H$ supplied to the halogen lamp 13 and the power consumption $W_H$, and therefore, if the supplied voltage $V_H$ is detected, the power consumption $W_H$ is substantially detected.

Second Example

In place of the charger control in Example 1, the DC component $V_{DC}$ of the developing bias may be changed (bias control). Similarly to the foregoing example, it is assumed that the F-value when the power meter 36 detects 1500 W is larger than F7. When the DC voltage $V_{DC}$ of the development bias is changed by the bias control means 6a so as to be equivalent to the light quantity change of the exposure lamp corresponding to the original image density of 0.3, the DC voltage $V_{DC}$ of the developing bias from F7 to F9, the development contrast $V_C$ and Dmax density, are as shown in following Table 3.

TABLE 3

| F-value | Dev. bias DC level $V_{DC}$ (V) | Dev. Contrast $V_C$ (V) | Dmax density |
|---|---|---|---|
| 7 | 150 | 244 | 1.30 |
| 8 | 180 | 214 | 1.30 |
| 9 | 210 | 184 | 1.30 |

Therefore, if the power consumption exceeds a predetermined level, the DC voltage $V_{DC}$ of the developing bias is changed in the following manner, for example, on the basis of the exposure amount and the DC voltage $V_{DC}$ of the developing bias for the F-value resulting in the power consumption below the predetermined level:

(F-value change)×30 V+(reference DC voltage of the developing bias)

Third Example

Figure 7:
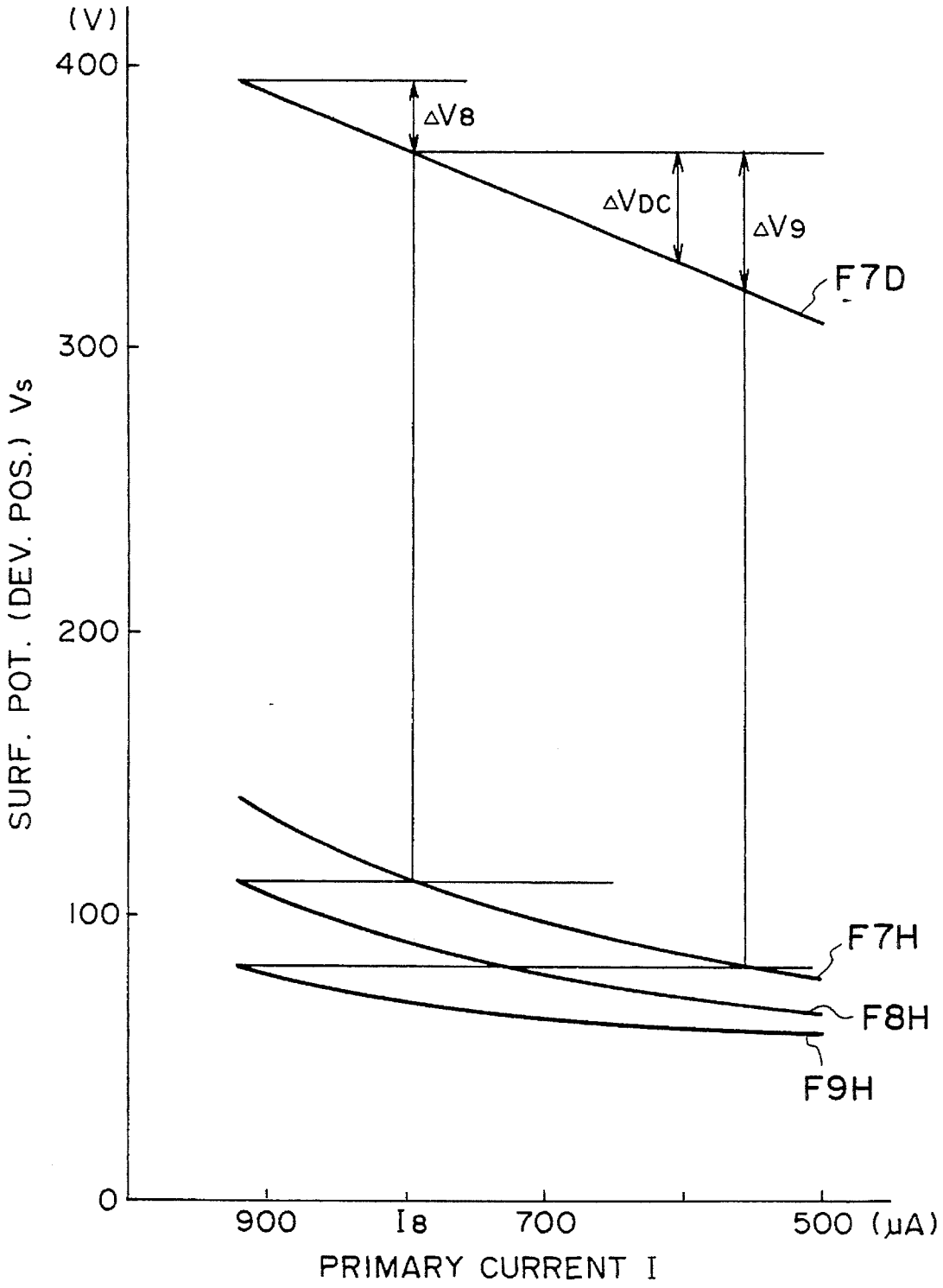
FIG. 7 is a graph showing a relationship between a primary current and a surface potential of a photosensitive member, according to a third embodiment of the present invention.

In place of the charger control in Example 1, the charger control and the bias control may be combined. It is assumed as in Example 1 that the F-value when the power meter 36 detects 1500 V is larger than F7. The surface potential $V_S$ of the photosensitive member is changed so as to be equivalent to the light quantity change of the halogen lamp corresponding to 0.3 of the original image density. When the F-value is changed F7 to F8 as shown in FIG. 7. The charger control results in the change $\Delta V_8$ of the development contrast $V_C$. By the bias control, it is $\Delta V_{DC}$. Since $\Delta V_8<\Delta V_{DC}$, the charger control is advantageous. Therefore, the charger control is used for the change from F8 to F9 after the charger control for the change from F7 to F8, the change of the development contrast is $\Delta V_9$, as shown in FIG. 7. Therefore, $\Delta V_9>\Delta V_{DC}$. Therefore, the bias control is more advantageous in the case of the change from F8 to F9. The primary current I, the DC voltage $V_{DC}$ of the development bias, the development contrast $V_C$ and Dmax density from F7 to F9, are shown in following Table 4.

TABLE 4

| F-value | Primary (μA) | Primary current rate (%) | Dev. bias DC level $V_{DC}$ (V) | Dev. contrast $V_C$ (V) | Dmax. density |
|---|---|---|---|---|---|
| 7 | 920 | 100 | 150 | 244 | 1.30 |

TABLE 4-continued

| F-value | Primary (μA) | Primary current rate (%) | Dev. bias DC level $V_{DC}$ (V) | Dev. contrast $V_C$ (V) | Dmax. density |
|---|---|---|---|---|---|
| 8 | 792 | 86 | 150 | 218 | 1.30 |
| 9 | 792 | 86 | 180 | 188 | 1.30 |

Thus, when the power meter 36 detects the power consumption beyond a predetermined level, the charger control is used upon one level increase of the F-value, and the bias control is used upon more than 1 F-value increase, on the basis of the exposure amount, the primary current level I, the DC voltage $V_{DC}$ of the development bias which result in the power consumption not more than the predetermined power consumption level. The following Table 5 shows an example.

TABLE 5

| F-value change | Primary current output rate (%) | Dev. bias DC level Change (V) |
|---|---|---|
| 0 | 100 | 0 |
| 1 | 86 | 0 |
| 2 | 86 | +30 |
| 3 | 86 | +60 |

As described in the foregoing, according to the embodiments of the present invention, the power consumption of the exposure means or the applied voltage is detected; when the output exceeds a predetermined level, the charging means, developing device or the like in place of the exposure means is used to adjust the image density, by which the electric power to be supplied to the fixing device can be maintained. Even if the duty of the fixing device is large as in the case of a great number of continuous copying operations, the stabilized image quality can be maintained without the necessity for lowering the copying speed or temporarily stopping the copying operation.

The object for which the power consumption is detected in the main assembly of the apparatus, includes the power consumption (wattage), voltage applied to an element or current supplied thereto. The element consuming the electric power, includes the fixing device and the exposure device which consume the largest electric power, driving motor, control circuit, an automatic document feeder, sorter or the like.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an electrophotographic photosensitive member;

means for charging said photosensitive member;

exposure means for exposing said photosensitive member to light information with a controllable amount of light to form an electrostatic latent image with a controlled image density;

developing means for developing the electrostatic latent image with toner;

image fixing means for heat-fixing the toner image;

detecting means for detecting an amount of electric power consumed by said image forming apparatus while in operation;

power supply control means for controlling electric power supply to said apparatus without changing electric power supply to said fixing means and without increasing electric power supply to said exposure means; and image density adjusting means for adjusting image density without changing the amount of light information exposed by said exposure means, wherein when said detecting means detects the power consumption beyond a predetermined level, the electric power supply to said exposure means is reduced or is maintained constant and said image density adjusting means is operated without changing the electric power supply to said fixing means, so as to adjust the density of the image.

2. An apparatus according to claim 1, wherein said image density adjusting means includes charge control means for controlling an amount of charge applied by said charging means to said photosensitive member.

3. An apparatus according to claim 1, wherein said image density adjusting means includes developing bias adjusting means for adjusting a developing bias of said developing means.

4. An apparatus according to claim 1, wherein said image density adjusting means includes charge control means for controlling an amount of charge applied by charging means to said photosensitive member and development bias adjusting means for adjusting a development bias of said developing means.

5. An apparatus according to claim 1, wherein said power detecting means detects wattage consumed by said apparatus.

6. An apparatus according to claim 1, wherein said power detecting means detects a voltage applied to an element in said apparatus.

7. An image forming apparatus, comprising:

an electrophotographic photosensitive member;

means for charging said photosensitive member;

exposure means for exposing said photosensitive member to light information with a controllable amount of light to form an electrostatic latent image with a controlled image density;

developing means for developing the electrostatic latent image with toner;

image fixing means for heat-fixing the toner image;

detecting means for detecting an amount of electric power consumed at least by said exposure means and image fixing means while said apparatus is in operation;

power supply control means for controlling electric power supply to said apparatus without changing electric power supply to said fixing means and without increasing electric power supply to said exposure means; and image density adjusting means for adjusting image density without changing the amount of light information exposed by said exposure means, wherein when said detecting means detects the power consumption beyond a predetermined level, the electric power supply to said exposure means is reduced or is maintained constant and said image density adjusting means is operated without changing the electric power supply to said fixing means, so as to adjust the density of the image.

8. An apparatus according to claim 7, wherein said image density adjusting means includes charge control means for controlling an amount of charge applied by said charging means to said photosensitive member.

9. An apparatus according to claim 7, wherein said image density adjusting means includes developing bias adjusting means for adjusting a developing bias of said developing means.

10. An apparatus according to claim 7, wherein said image density adjusting means includes charge control means for controlling an amount of charge applied by said charging means to said photosensitive member and development bias adjusting means for adjusting a development bias of said developing means.

11. An apparatus according to claim 7, wherein said power detecting means detects wattage consumed by said apparatus.

12. An apparatus according to claim 7, wherein said power detecting means detects a voltage applied to an element in said apparatus.

13. An image forming apparatus comprising:

image forming means for forming an image on a recording material, said image forming means including a photosensitive member and exposure means for exposing the photosensitive member with an amount of image light;

means for detecting a parameter corresponding to electric power consumption of said apparatus; and density adjusting means for adjusting an image density of the image formed on the recording material, said density adjusting means being operable, in accordance with the parameter detected by said detecting means, selectively in a first mode in which an increase of the amount of image light exposure is permitted and in a second mode in which an increase of the amount of image light exposure is prevented.

14. An apparatus according to claim 13, wherein said image forming means includes charging means for charging the photosensitive member before exposure to the image light, and developing means for developing the photosensitive member with toner.

15. An apparatus according to claim 14, wherein said density adjusting means adjusts, in the second mode, the amount of the charge applied to the photosensitive member by said charging means.

16. An apparatus according to claim 14 or 15, wherein said density adjusting means adjusts, in the second mode, a voltage applied to the developing means.

17. An apparatus according to claim 13 or 14, further comprising image fixing means for fixing the image on the recording material by heat.

18. An apparatus according to claim 13, wherein when the parameter is smaller than a predetermined level, the first mode is selected, and when the parameter is not smaller than the predetermined level, said second mode is selected.

19. An apparatus to claim 13, wherein said exposure means includes a lamp.

20. An apparatus according to claim 13, wherein in said second mode, the exposure amount is prevented to increase even when image density setting is changed.

21. An image forming apparatus comprising:

image forming means for forming an image on a recording material, said image forming means including a photosensitive member and exposure means for exposing the photosensitive member with an amount of image light;

means for detecting a parameter corresponding to electric power consumption of said apparatus; and density adjusting means for adjusting an image density of the image formed on the recording material, said density adjusting means being operable selectively in a first mode in which an increase of the amount of the exposure is permitted and in a second mode in which an increase of the amount of the exposure is prevented, wherein the first mode is selected when the parameter is smaller than a predetermined level, and the second mode is selected when the parameter is not smaller than the predetermined level.

22. An apparatus according to claim 21, further comprising image fixing means for fixing the image on the recording material by heat.

23. An apparatus according to claim 21, wherein said exposure means includes a lamp.

* * * * *

UNITED STATES PATENT AND TRADEMARK OFFICE

CERTIFICATE OF CORRECTION

PATENT NO. : 5,455,657
DATED : October 3, 1995
INVENTOR(S) : ATSUSHI TAKEDA

It is certified that error appears in the above-indentified patent and that said Letters Patent is hereby corrected as shown below:

Column [56] RC,
line FPD, "2205078 8/1990 Japan" should read --2-205078 8/1990 Japan--; and
line FPD, "3033771 2/1991 Japan" should be deleted.

Column 4,
line 8, "it" should read --when it--; and
line 33, "Figure FDC" should read --Figure $V_{DC}$--.

Column 5,
line 22, "$V_{D8}$ $V_{DC}$" should read --$V_{D8}$ - $V_{DC}$--.

Column 10,
line 11, "to" should read --according to--.

Signed and Sealed this

Twenty-third Day of January, 1996

Bruce Lehman

*Attest:*

BRUCE LEHMAN

*Attesting Officer*

*Commissioner of Patents and Trademarks*